United States Patent [19]

Heddebaut et al.

[11] Patent Number: 4,932,617

[45] Date of Patent: Jun. 12, 1990

[54] SYSTEM FOR TRANSMITTING BROADBAND DATA AND/OR INSTRUCTIONS BETWEEN A MOVING ELEMENT AND A CONTROL STATION

[75] Inventors: Marc Heddebaut, Sainghin en Melantois; Pierre Degauque, Lambersart; Denis Duhot, Paris; Pierre Mainardi, Douvrin, all of France

[73] Assignee: Societe Anonyme dite: ALSTHOM, Paris, France

[21] Appl. No.: 131,796

[22] Filed: Dec. 11, 1987

[30] Foreign Application Priority Data

Dec. 12, 1986 [FR] France ..... 86 17425
Mar. 18, 1987 [FR] France ..... 87 03734

[51] Int. Cl.[5] ..... B61L 27/00

[52] U.S. Cl. ..... 246/8; 343/770; 340/933

[58] Field of Search ..... 340/22, 47, 933, 928, 340/534; 246/63 C, 30, 29 R, 14, 122 R, 124, 1 C, 185, DIG. 1, 8, 121; 180/167, 168; 343/767, 770, 771, 785, 781 R

[56] References Cited

U.S. PATENT DOCUMENTS

| | | | |
|---|---|---|---|
| Re. 28,302 | 1/1975 | Staras et al. | 343/5 R |
| Re. 28,867 | 6/1976 | Baba et al. | 343/770 |
| 2,840,818 | 6/1958 | Reed et al. | 343/770 |
| 3,281,591 | 10/1966 | Takeya | 246/8 |
| 3,328,800 | 3/1964 | Algeo | 343/768 |
| 3,348,227 | 8/1964 | Rolfs | 343/768 |
| 3,467,962 | 9/1969 | Laplume et al. | 343/6.5 |
| 3,470,474 | 9/1969 | Rohrer | 455/55 |
| 3,509,571 | 4/1970 | Jones et al. | 343/771 |
| 3,570,007 | 3/1971 | Whitehead | 343/771 |
| 3,599,216 | 8/1971 | Paine | 343/771 |
| 3,648,172 | 3/1972 | Nakahara | 324/51 |
| 3,729,740 | 4/1973 | Nakahara et al. | 343/713 |
| 3,766,378 | 10/1973 | Baba et al. | 246/63 C |
| 3,964,063 | 6/1976 | Narbaits-Jaureguy et al. | 340/933 |
| 4,338,587 | 7/1982 | Chiappetti | 340/928 |
| 4,511,886 | 4/1985 | Rodriquez | 340/534 |
| 4,578,665 | 3/1986 | Yang | 246/121 |
| 4,716,415 | 12/1987 | Kelly | 343/771 |

FOREIGN PATENT DOCUMENTS

| | | |
|---|---|---|
| 177449 | 1/1972 | Fed. Rep. of Germany . |
| 2593761 | 8/1987 | France . |
| 2010049 | 6/1979 | United Kingdom . |

OTHER PUBLICATIONS

"Waveguide Communication System for Centralized Railway Traffic Control", Kawakami et al, IEEE Transactions Vehicular Communications, vol. VC-13, No. 1, Sep. 1954, pp. 1-18.

*Primary Examiner*—Andres Kashnikow
*Assistant Examiner*—Mark T. Le
*Attorney, Agent, or Firm*—Sughrue, Mion, Zinn, Macpeak & Seas

[57] ABSTRACT

A system for transmitting data and/or instructions and/or localization between a moving element and a control station. The system includes a hollow tube running parallel to the path of the moving element and constituting a waveguide, the tube having an emitting face which is pierced by a network of openings, and the moving element including a pair of microwave transmit and/or receive antennas. The network of openings on the emissive face of the hollow tube makes it possible to transmit two distinct electric field signals between the openings and the transmit and/or receive antenna. One of the signals serves to transmit data and/or instructions, and the other serves to measure the speed and the position of the moving element by detecting the presence of the second signal. Other systems relate to the application of such hollow tubes to automobile toll stations for monitoring an enclosure which is dangerous for personnel.

6 Claims, 9 Drawing Sheets

SYSTEM FOR TRANSMITTING BROADBAND DATA AND/OR INSTRUCTIONS BETWEEN A MOVING ELEMENT AND A CONTROL STATION

The present invention relates to a system for transmitting broadband data and/or instructions between a moving element and a control station for said element, the system including a hollow tube running parallel to the path followed by the moving element and constituting a waveguide having an emissive face which is pierced by a network of openings for passing electromagnetic radiation at microwave frequencies, the moving elements being provided with at least one transmit and/or receive antenna for microwaves disposed facing that face of the tube which is pierced with the network of openings, and the hollow tube being connected to at least one microwave feed member and to a member for receiving microwaves coming from the tube.

The primary application of the invention is as a system for transmitting broadband data and/or instructions and/or localization signals between a vehicle, in particular a road or rail vehicle, and a control station for said vehicle.

BACKGROUND OF THE INVENTION

Proposals have already been made in the publication "Waveguide Communication System for Centralized Railway Traffic Control," by T. Kawakami et al, IEEE Trans. on Vehicular Communications, September 1964, pp. 1–18, to dispose a circular waveguide along the track of a high speed train, the waveguide being provided with directional couplers and with radiating auxiliary waveguides, and with the trains being provided with transmit and/or receive antennas. Such a system makes it possible to transmit data and telephone conversations and television pictures between the train and a control station. However, it requires relatively complex and expensive apparatus to be installed all along the track. It was only used experimentally along a length of track, and solely for transmitting data, and to this day has not given rise to industrial use. A system of the same nature described by H. M. Barlow, in "The Radio and Electronic Engineer", May 1967, pp. 275–281, using a different waveguide structure and likewise for the sole purpose of transmitting data, suffers from the same drawback of complexity and cost and has likewise not given rise to industrial exploitation.

SUMMARY OF THE INVENTION

The first system in accordance with the invention seeks to make it possible not only to transmit data, but also to control the motion of vehicles such as trains which may run on rails or which may be driven by linear motors, or funicular railways, or elevators, or surveillance vehicles inside enclosures, or automobiles, using components which are simpler and cheaper than those described in said publications.

This system is characterized in that the network of openings pierced through the emitting face of the hollow tube is such as to enable transmission between said openings and the transmit and/or receive antenna.

The system preferably satisfies at least one of the following features:

the openings in the emitting face have a long dimension which is much greater than their perpendicular dimension, in that some of them are perpendicular to the axis of the hollow tube, and in that some other ones of them slope relative to said axis, and are disposed in a particular pattern corresponding to appropriate coding, the openings which are perpendicular to the axis transmitting and axial component $E_z$ conveying the data and/or the instructions, and the openings which slope relative to the axis additionally transmitting a perpendicular component $E_y$ enabling the vehicle to determine its absolute position and any other information related thereto, in particular a speed limit.

The member for feeding the hollow tube with microwaves is a transmitter for transmitting at two different frequencies, one of the frequencies being used for exchanging data and/or instructions, and the other providing major fluctuations in amplitude of the signals received by an antenna fixed to the moving elements and remaining close to the face of the tube which is pierced with openings thereby enabling the location and the speed of the moving elements to be measured by counting the number of openings.

The tube is a hollow rail for supplying power to a railway vehicle, or is a reaction plate in a linear motor propulsion system.

The inside faces of the hollow tube are provided with an electrolytic deposit of a metal which is a good conductor of electricity.

The cross-section of the tube is H-shaped, thereby constituting a top radiating waveguide and a bottom radiating waveguide which are separated from each other by a web, in that said web is pierced by a network of openings, in that the top waveguide is provided with electrical short circuits forming directional couplers and associated with corresponding layers of microwave absorbent material to allow microwave energy to pass solely from the bottom waveguide to the top waveguide, thereby dividing the top waveguide into lengths, in that the bottom waveguide is connected to a member for feeding the waveguide with microwaves carrying information and/or instructions for all moving elements, and in that the top waveguide is connected to a member for feeding it with microwaves carrying information and/or instructions for and/or from only those moving elements moving along the individual lengths delimited by pairs of successive electrical short circuits and the associated absorbent materials.

The face of the tube which is pierced with a network of openings is made of a plastic material which is covered by a thin layer of metalization in which the network of openings is etched.

At least on some lengths of the hollow tube, the openings for enabling the moving element to be located and for measuring its speed are separated by intervals such that the speed of the moving element can be controlled by setting a time interval at which the corresponding antenna of the moving element should pass over said openings.

It will be understood that the cross-section of the tube may in the general case be any desired section, e.g. elliptical, circular, or rectangular. However, a rectangular section is mechanically simple.

Equidistant openings provided in the radiating face of the hollow tube make it possible to determine the speed of the moving element simply by counting the number of detections by a localization antenna during a given time interval. Position is obtained by multiplying the number of detections by the distance between two successive openings.

The openings for measuring the speed and position of the moving element may also be disposed in such a manner that successions of signal presence or absence may be encoded so as to record data such as the absolute position or the speed limit at any given point along a path.

The connections of the radiating waveguides at the gaps which are required for expansion or, for railway vehicles, by the gaps for passing track equipment, may be constituted by a waveguide-to-coaxial-cable transition, a length of flexible coaxial cable, and a coaxial-cable-to-waveguide transition.

In order to compensate for signal attenuation along the path of the moving element, even though this attenuation is moderate, conventional repeaters may be installed from place to place in order to regenerate the signals. In addition, the waveguides may be pierced with openings whose sizes increase in stages so as to compensate for linear attenuation losses and thus obtain substantially constant transmitted signal levels, regardless of whether the moving element is close to a receiver or at the limit of its range.

A system as defined above can be used for exchanging wideband analog data and/or high bit-rate digital data, such as telephone and/or video signals, or such as telemetry and/or remote control signals, and in addition it makes it possible to measure the position and/or the speed of the moving element as it moves in the vicinity of the tube constituting the microwave waveguide.

A second system in accordance with the invention seeks to provide for the transmission of data and/or instructions between road vehicles and a toll or control stations at the entrances to toll roads or to limited-access roads, without requiring the road vehicles to stop at the toll or control stations. It is characterized in that it comprises at least one length of road provided with a hollow waveguide-forming tube disposed upstream from an access barrier, and in that said tube is connected to a control station which is provided with a link to a center for supplying and recording bank data or authorization data, and also to a member for controlling the opening of said access barrier.

Preferably, the hollow tube parallel to the length of road serves to interrogate the vehicle, to receive identification data, to allow said data to be processed by the control station, and then to confirm the identification data and open the access barrier.

The third system in accordance with the invention seeks to enable data and/or instructions to be transmitted between a control station and an observation video camera disposed inside an enclosure to which access cannot be obtained without danger, e.g. an enclosure subjected to ionizing radiation. It is characterized in that the system comprises an electronics box having an antenna for microwave transmission and reception, said box being connected to the camera, together with a waveguide-forming hollow tube disposed facing the antenna for transmission, said tube being connected to the control station and including a member for receiving and processing microwave signals emitted from the electronics box and for transmitting the processed signals to a television screen.

BRIEF DESCRIPTION OF THE DRAWINGS

Systems for transmitting data and/or instructions in accordance with the invention are described below, by way of example, with reference to the diagrammatical figures of the accompanying drawings, in which.

MORE DETAILED DESCRIPTION

Figure 1:
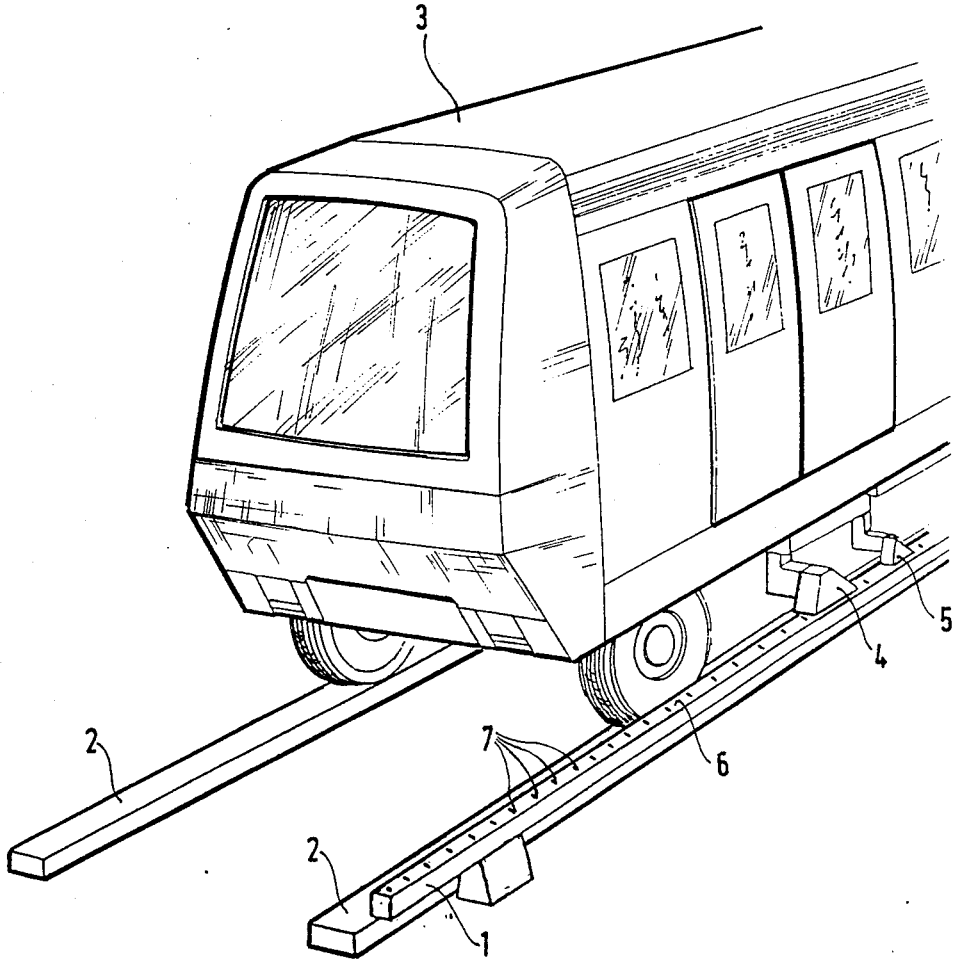
FIG. 1 is a perspective view of a rail vehicle together with portions of rail and hollow tube forming a waveguide parallel to the track.

In FIG. 1, a rail vehicle 3, for example the driving car of an underground railway unit, runs on rails 2 close to a physically embodied transmission medium in the form of a hollow tube constituting a waveguide 1 which radiates by virtue of asymmetrical geometrical openings constituting a network 7 in one of the faces 6 of the transmission medium. The driving car is provided with a transmit and receive antenna 4 and also with a localization antenna 5. The transmit and receive antenna serves to transmit data or control instructions between the driving car and a traffic control station which is connected to an end of the waveguide, and it is constituted by one or more elementary antennas which are coupled to one another in order to provide gain and amplitude regulation for the transmitted and received signals.

The localization antenna 5 serves to measure a different component of the microwave electromagnetic field received above the waveguide and/or to receive a different microwave signal wavelength. Supposing, for example, that the openings are equally spaced and at a known distance apart, then the signals received by the localization antenna give the position of the vehicle as a number of periods and the speed of the vehicle as a frequency of transitions.

It is also possible, for example, to servocontrol the speed of the vehicle to ensure that its localization antenna receives radiation from the openings at given time intervals.

Figure 2:
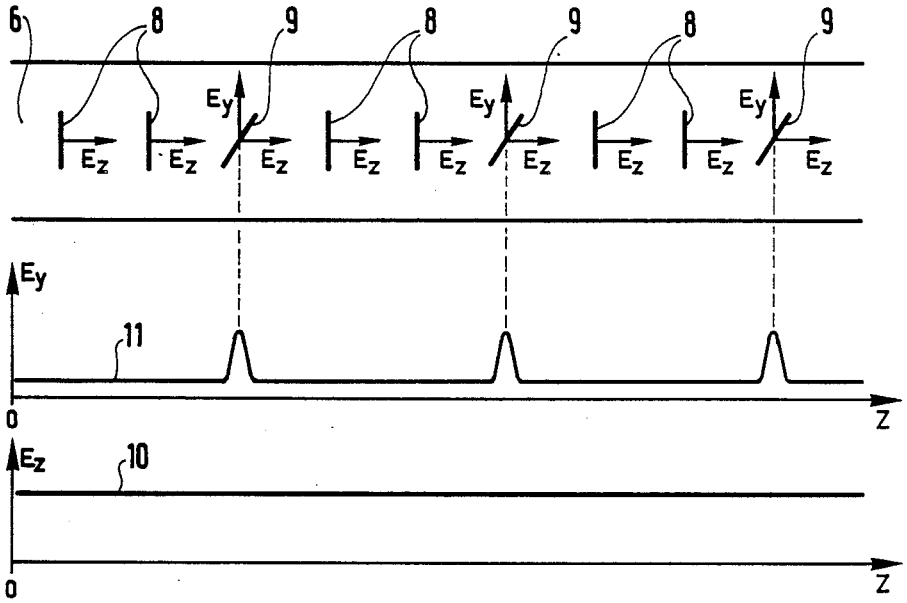
FIG. 2 is a view on a larger scale of the face of the FIG. 1 waveguide which is pierced with a network of openings whose particular orientations serve to reveal two different components of the field radiated by the waveguide, thereby making it possible to perform the functions of transmission, and/or localization, and/or speed measurement.

FIG. 2 shows how it is possible on the face 6 which is pierced by the network of openings, some of which (8) are perpendicular to the axis of the waveguide while others (9) slope relative to said axis, to orient the openings so as to receive a constant amplitude of the component $E_z$ (straight line 10) enabling transmission to take place, and also to receive a discontinuous signal (curve 11) by means of the $E_y$ component, thereby enabling localization and vehicle speed to be measured, as seen above.

Figure 3:
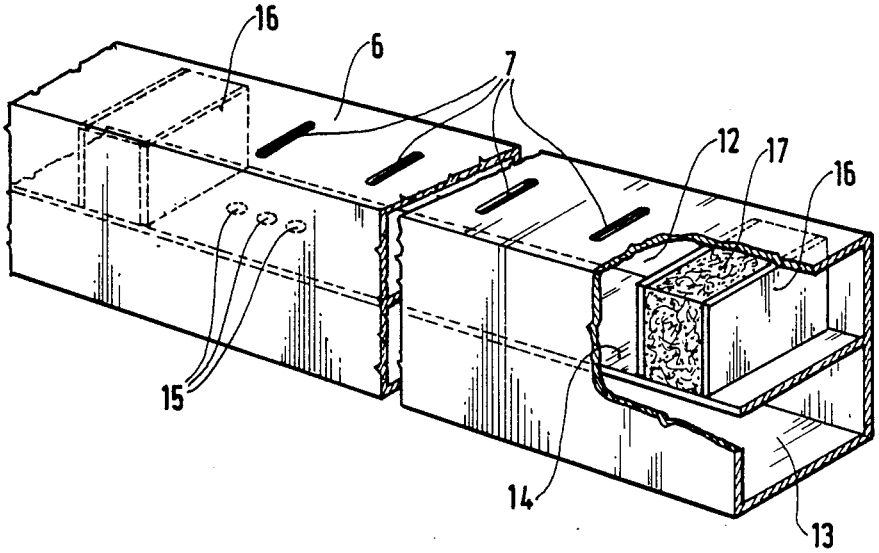
FIG. 3 is a partially cutaway view of a length of power supply rail having an H-shaped cross-section and serving as two waveguides.

FIG. 3 shows a top waveguide 12 and a bottom waveguide 13 in a common waveguide structure of H-shaped section. Signals which are common to all vehicles are conveyed by the bottom waveguide 13 and are coupled to the top waveguide 12 via directional couplers constituted by openings 15 situated through the bottom web 14 of the top waveguide. Electrical short circuits 16 split the top waveguide into lengths which may correspond, for example, to block sections. An absorbent material 17 prevents standing wave phenomena from occurring in the top waveguide. The top waveguide is connected to a different microwave transmit and receive member enabling information and/or control instructions to be exchanged with vehicles located on the length delimited by two consecutive electrical short circuits 16. Stationary automatic pilot points installed along the track may communicate with the central control station by injecting a data carrying microwave signal into the bottom waveguide.

The hollow tube 1 of FIG. 1 or as shown in FIG. 3 may have geometrical dimensions which are compatible with the tube also providing the function of a power supply rail and/or of a guide rail.

Figure 4:
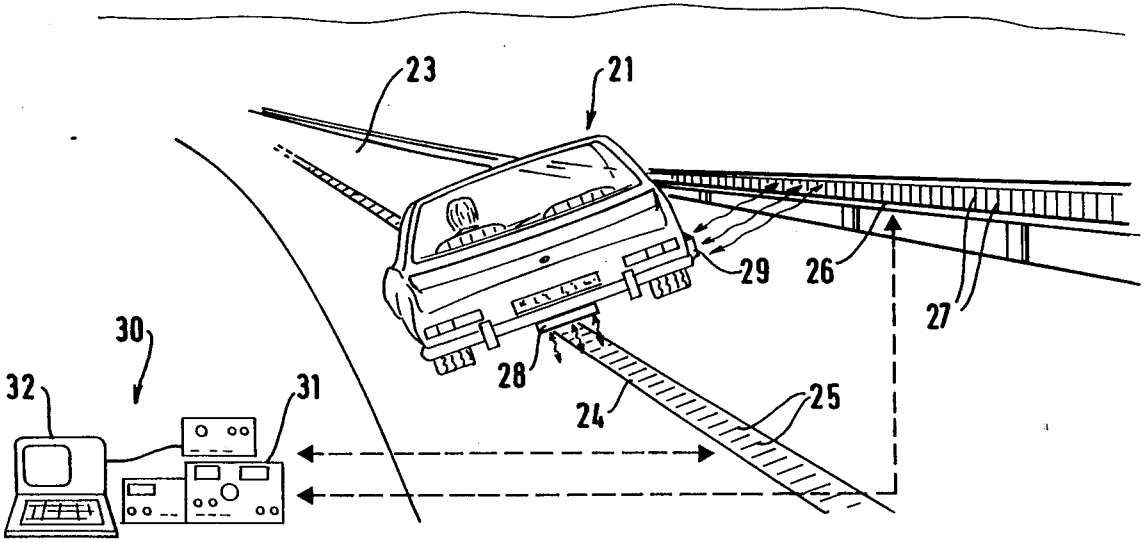
FIG. 4 shows a portion of a test circuit for automobiles.

FIG. 4 shows an automobile test track belonging, for example, to an automobile manufacturer or to a tire manufacturer, or to an organization for approving types of automobile. The vehicle 21 travels along a test track 23. The track includes a tube of rectangular cross-section for conveying data and/or instructions at high speed by means of microwaves, said tube being provided with openings that are generally rectangular in shape and extending perpendicularly to its axis. The hollow tube may be buried in the axis of the track with its top face being level with the road surface (tube 24 provided with openings 25) or else it may be disposed on one side of the road slightly above ground level (tube 26 provided with openings 27), in which case it may be supported by a safety barrier. The vehicle is provided in the first case with a pair of transmit and receive antennas 28 beneath the bodywork. In the second case, the vehicle is provided with a pair of transmit and receive antennas 29 mounted on the side of the vehicle which faces the hollow tube.

The hollow tube for transmitting microwaves receives signal-carrying energy at one end from a test control center 30 transmitting over a first channel A via a transmitter 31 connected to a control desk 32, and it likewise receives signal carrier energy at any point around the track as transmitted by the vehicle during testing. At the other end of the waveguide, a recording station (not shown) eliminates channel A signals and receives signals on some other channel B coming from the vehicle, which signals are amplified and shaped prior to utilization.

Figure 5:
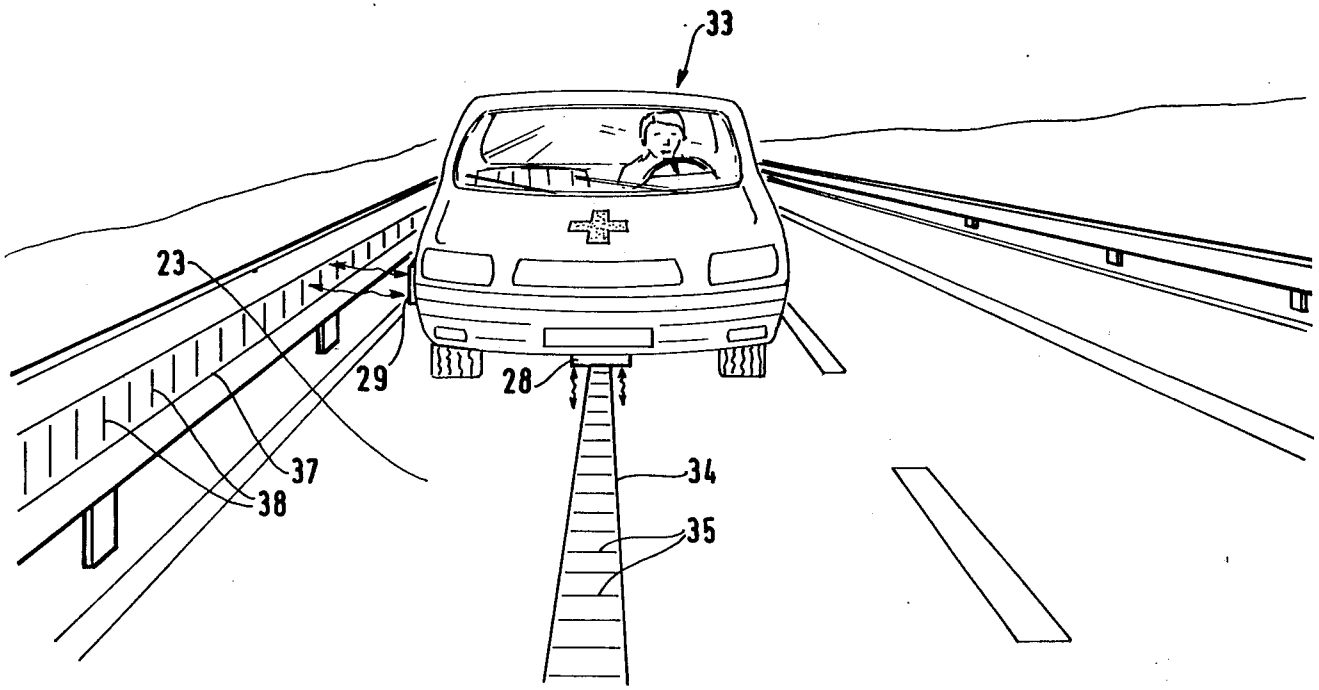
FIG. 5 shows a priority vehicle running along a road provided with a system for interchanging data and instructions.

FIG. 5 shows a system for exchanging data and instructions between a vehicle, for example a priority vehicle such as a police car, an ambulance, a fire engine, or a doctor, and a road control station. The vehicle 33 runs along a road having a hollow tube constituting a microwave waveguide disposed therealong, either in the form of a tube 34 which is embedded along the axis of the road with its top face provided with rectangular openings 35 being at road surface level, or else in the form of a tube 37 provided with openings 38 and disposed along the side of the road slightly above ground level and carried, for example, by a safety barrier. In the first case, the vehicle has a pair of transmit and receive antennas 28 fixed beneath its bodywork, and in the second case it has a pair of transmit and receive antennas 29 fixed on its side facing the hollow tube.

The waveguide-forming hollow tube is then provided with signal-regenerating repeaters disposed from place to place in order to compensate for signal attenuation along the road.

Such a system may be adapted to control vehicles which are equipped with anti-collision devices.

Figure 6:
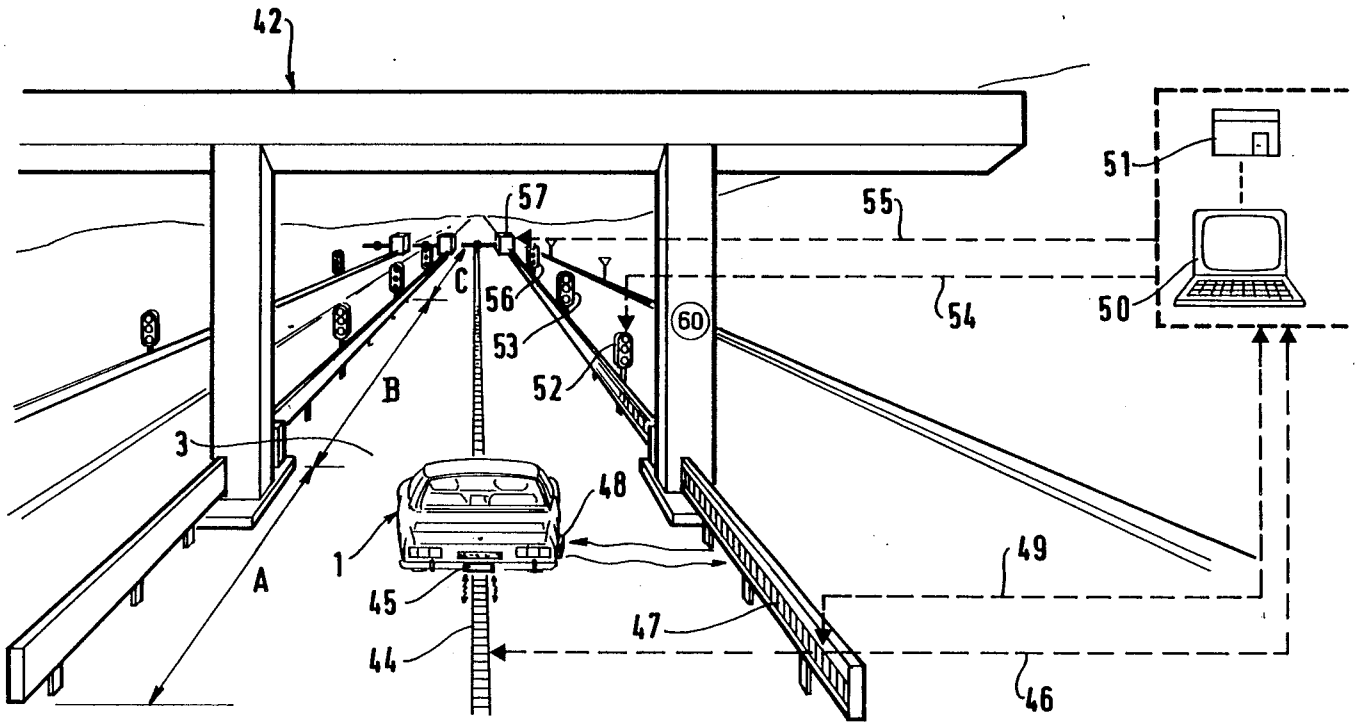
FIG. 6 shows an automatic toll station that does not require vehicles to stop at the entrance to a toll road.

In FIG. 6, the vehicle 1 is arriving at the entrance of an automatic toll station 42 at the beginning of a toll road. The access lane is provided with a hollow rectangular tube 44 of square or rectangular cross-section and constituting a waveguide which is embedded along the axis of the lane and whose top face is provided with rectangular openings extending perpendicularly to its axis for directing radiation upwardly from the surface of the road.

The bottom of the vehicle bodywork is then provided with a transmit antenna 45 and optionally with a receive antenna, both of which are downwardly directed. The hollow tube 44 communicates with a control station 50 over a high speed microwave link 46 represented by dashed lines.

In a variant, the access lane has a rectangular tube 47 running along a side thereof at a short distance above the ground, and the vehicle is provided near the bottom of a side thereof with a transmit antenna 48 facing the tube. The tube communicates with the control station 50 over a high speed microwave link 49 represented by a dashed line. The distance between the vehicle antenna and the lateral hollow tube is preferably no greater than 2 meters.

Although two variant embodiments are possible, one comprising a tube embedded along the axis of the access lane and the other comprising a tube running along the side of the lane, and although both have been shown together in a single figure, it will be understood that in practice, only one or other of the embodiments is provided.

The lane along which vehicles pass is subdivided into three successive portions A, B, and C.

Portion A enables the control station 50 to interrogate the vehicle and to receive identification data via the hollow tube 44 or 47.

The second portion B is intended to allow the control station 50 to process said data: it interrogates a center for recording and supplying bank data 51, for verifying that a bank account exists and is in credit, and the account is then debited. Traffic lights 52 and 53 are controlled by the control station 50 by means of a microwave link 54 and are disposed adjacent to this portion of the road to inform vehicle drivers whether they may proceed, and if so how fast.

The third portion C enables the debit performed on a vehicle driver's bank account to be confirmed and also allows the vehicle to pass.

The control station 50 then applied a "green light" instruction to traffic lights 56 over a link 55 and simultaneously applies an "open" instruction to a gate 57.

Figure 7:
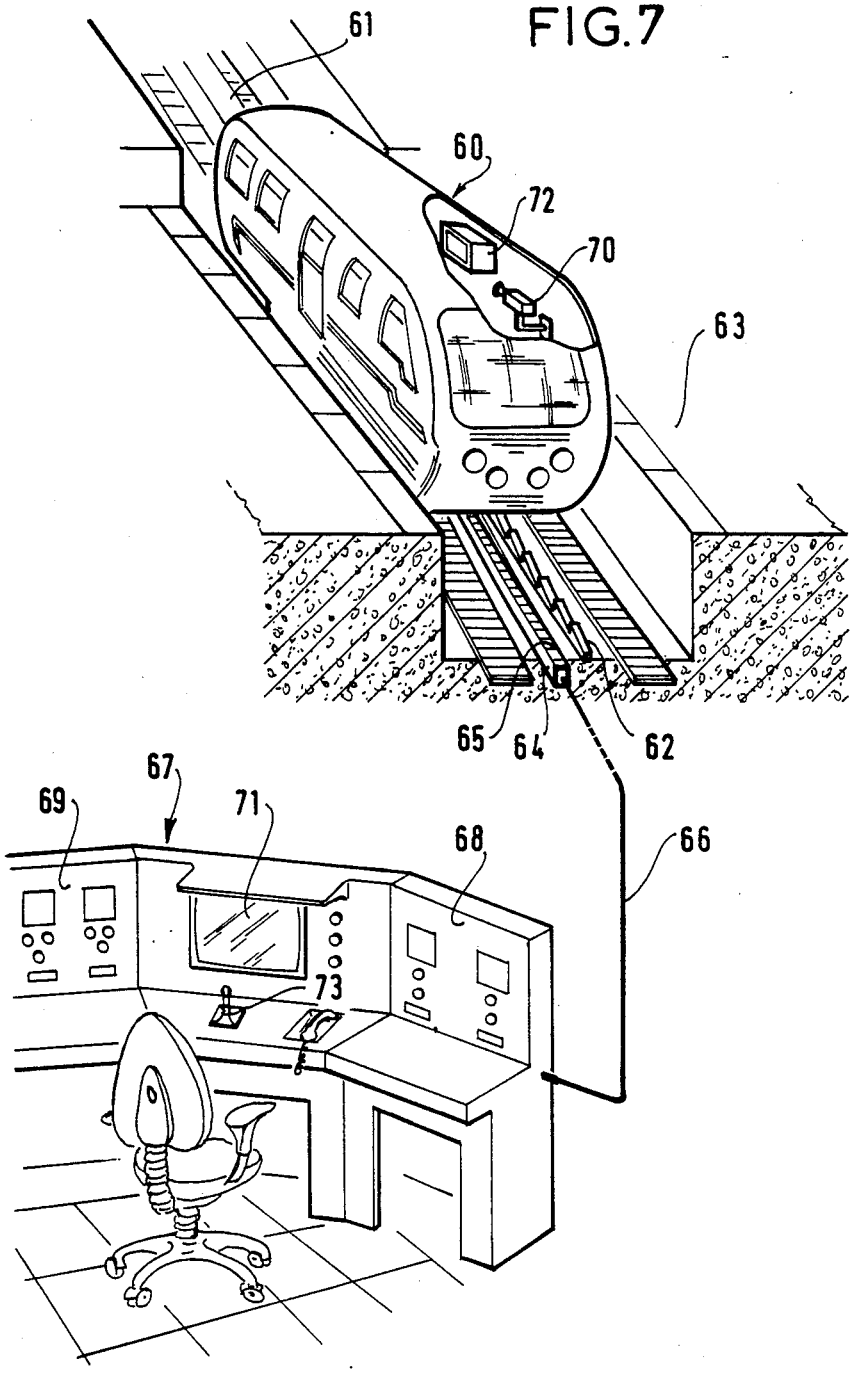
FIG. 7 shows a funicular railway and a corresponding length of track provided with a microwave waveguide next to its rack.

In FIG. 7, a funicular railway 60 runs along a track 61 having a rack 62 and the funicular is shown leaving a station 63. A tube constituting a microwave waveguide 64 is disposed between the tracks running parallel to the rack 62. The top face of the tube 65 is provided with geometrically asymmetrical openings analogous to those shown on a larger scale in FIGS. 2 and 3 for use by the driving car of an underground railway. The funicular includes a transmit and receive antena disposed on the bottom face of its bodywork facing the waveguide, and it is also provided with a localization antenna which is similarly disposed. Neither of these antennas is shown.

The waveguide is connected by a coaxial cable 66 to a control station 67 including a bay 68 for transmitting microwaves and a bay 69 for receiving data coming from the funicular.

The funicular may be provided, for example, with an internal video camera 70 for observing how many passengers it contains, and whose signals are transmitted via the waveguide and the coaxial cable to a television screen 71 disposed in the control station which is provided with a lever 73 for slowing down or stopping the funicular. In addition, a television screen 72 disposed inside the funicular is supplied with messages or with televized advertising or neither from the control station.

Figure 8:
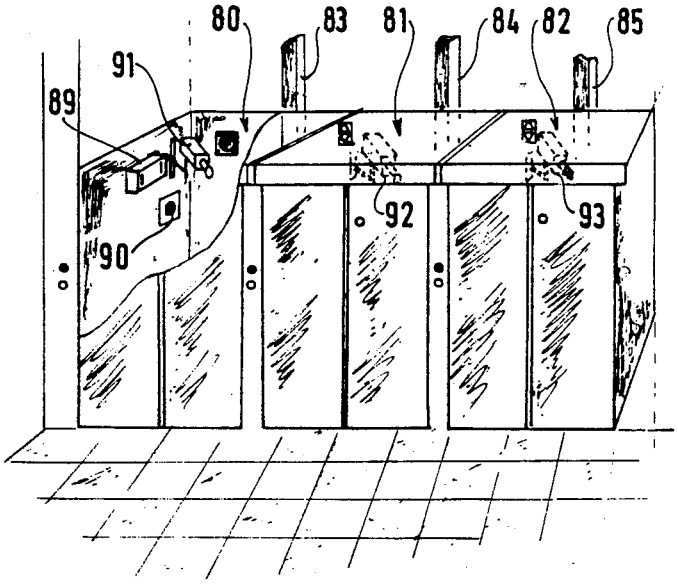
FIG. 8 shows a station for surveillance of the elevators in a building.
Figure 8:
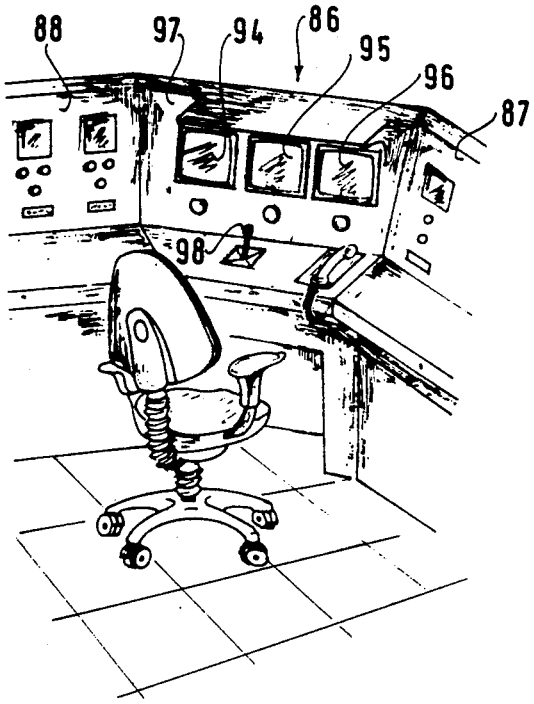

FIG. 8 shows a plurality of elevator shafts 80, 81, and 82 each provided with hollow vertical tubes constituting waveguides 83, 84, and 85 which are pierced in their faces facing the walls of the elevator cabins with networks of geometrically asymmetrical openings. Each elevator cabin is itself provided with a transmit and receive antenna and with a localization antenna, neither of which is shown. The waveguide-forming hollow tubes are connected by lengths of coaxial cable (not shown) to the control station 86. The control station is provided with a waveguide transmission bay 87 and a waveguide receive bay 88 for receiving information from the elevator cabins and for automatically controlling the displacements thereof. Each elevator cabin includes an electronics box such as 89 for generating microwaves, a microphone such as 90, and a surveillance video camera 91, 92, or 93. The data transmitted by the waveguide- forming tubes 83, 84, and 85 and by the coaxial cables, in particular concerning the positions and the speeds of the elevator cabins, are received by the receive bay 88 which includes television screens 94, 95, and 96 disposed in a control bay 97 facing a surveillance position, and they serve to display the situation inside each of the elevator cabins. A lever 98 enables the person at the surveillance position to stop any one of the elevators in the event of an incident.

Figure 9:
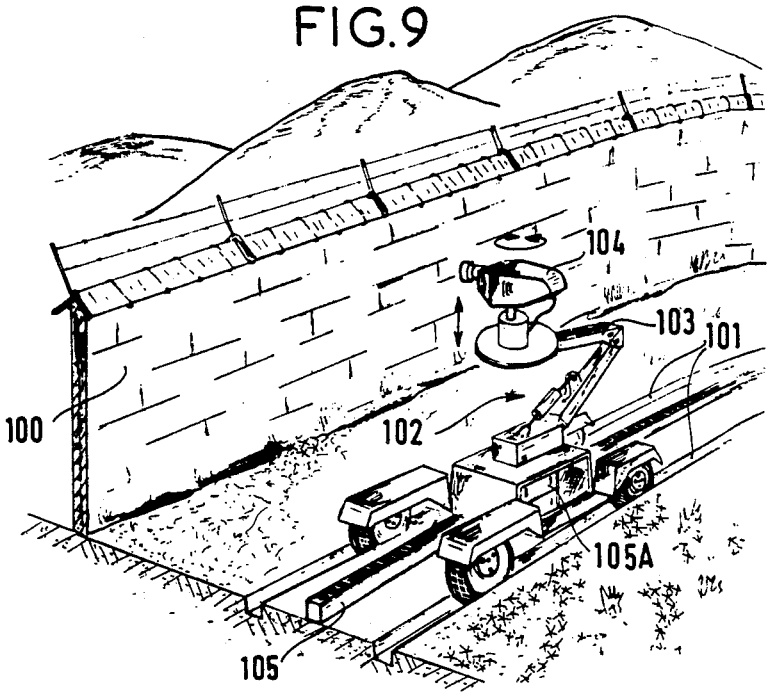
FIG. 9 shows a rail-mounted vehicle for performing surveillance of an enclosure by means of a video camera.
Figure 9:
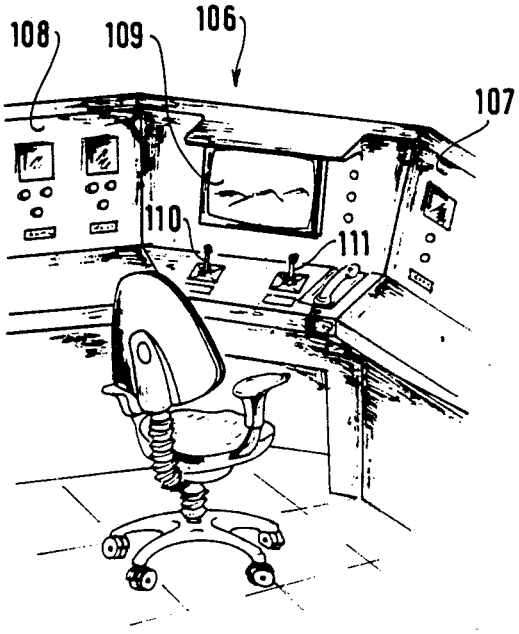

The surveillance installation shown in FIG. 9 is intended to detect any attempt at passing the wall 100 of a sensitive installation such as a military installation, a fuel depot, a nuclear power station, etc. . . . . To this end, two parallel grooves 101 are provided in the ground in the vicinity of the wall and form a guide path for a wheel-mounted vehicle 102 having an elevator arm 103 carrying a rotatable television camera 104. A tube constituting a microwave waveguide 105 is disposed in the ground between the grooves 101. The top face of this tube is pierced by rectangular openings for passing the microwaves. The vehicle 102 includes a microwave generator box 105A, and its bottom face has a transmit and receive antenna and a localization antenna, neither of which is shown. The hollow waveguide-forming tube is connected via a coaxial cable (not shown) to a surveillance station 106. The surveillance station includes a microwave generator 107, a receive bay 108 for receiving signals transmitted by the camera on the vehicle, and it feeds a television screen 109 disposed facing monitoring personnel. Levers 110 and 111 enable the height of the camera above the vehicle and the direction in which the camera is pointing to be controlled.

Figure 10:
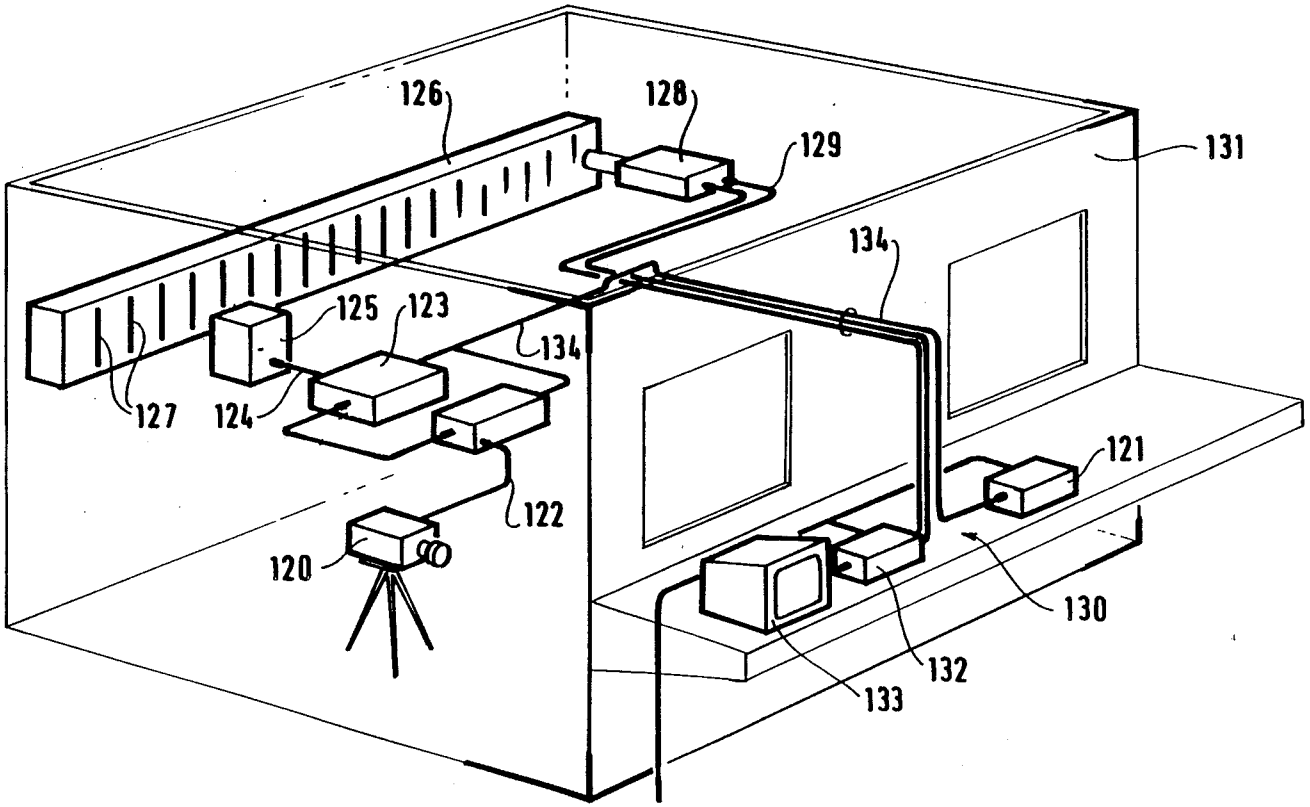
FIG. 10 shows a system for controlling a video camera used for observation in an enclosure which is subjected to ionizing radiation.

In the remote control installation shown in FIG. 10, a television camera 120 is powered by a box 121 and provides a video signal and a low frequency signal from a microphone (not shown). These signals are transmitted by a coaxial cable element 122 to a modulator 123 which generates a carrier wave at a frequency of about 600 MHz.

The modulated carrier wave is mixed with the wave from a local oscillator at a frequency of 1850 MHz, thereby generating a resultant signal at a frequency of 2450 MHz. After being amplified, this signal is transmitted via a short length of coaxial cable 124 to a slotted transmission antenna 125 disposed facing a horizontal rectangular tube constituting a waveguide 126, said tube being pierced by vertical slots 127. The waveguide is connected via an amplifier 128 and a coaxial cable 129 to a control station 130 which is disposed on the other side of a wall 131 providing separation from the enclosure which is subjected to ionizing radiation.

The coaxial cable 129 terminates at a receiver 132 which is connected to a television display 133.

The energy from the camera 120 disposed in the enclosure comes from the low voltage box 121 to which it is connected via the cable 134.

In operation, the signal transmitted by the antenna 125 induces a microwave signal in the waveguide tube 126. This signal is received at the end of the waveguide by a transition element which feeds the amplifier 128 which is in turn connected to a mixer disposed inside the receiver 132. The amplifier serves to avoid degrading the signal-to-noise ratio since there may be a distance of several meters between the amplifier and the receiver.

The mixer of the receiver 132 receives a signal at 2450 MHz at one input and a local oscillator signal at 1850 MHz on another input. It generates an output signal at 600 MHz which is the image of the originally transmitted signal. This signal is then demodulated to give a low frequency signal and a video signal which are applied to the television screen 133.

We claim:

1. A system for transmitting broadband data and/or instructions between at least one a moving element and a control station for said element, the system including a hollow tube running parallel to the path followed by the moving element, said hollow tube constituting a waveguide having an emissive face pierced by a network of openings for passing electromagnetic radiation at microwave frequencies, said at least one moving element being provided with at least one antenna for microwaves disposed facing that face of the tube which is pierced with the network of openings, and the hollow tube being connected to at least one microwave feed member and to a member for receiving microwaves coming from the tube, wherein the network of openings pierced through the emitting face of the hollow tube is such as to enable transmission between said openings and said antenna, and wherein the cross-section of the tube is H-shaped, thereby defining a top radiating waveguide and a bottom radiating waveguide separated from each other by a web, wherein said web is pierced by a network of openings, wherein the top waveguide comprises electrical short circuits forming directional couplers and associated corresponding layers of microwave absorbent material to allow microwave energy to pass solely from the bottom waveguide to the top waveguide, thereby dividing the top waveguide into lenghts, wherein the bottom waveguide is connected to a member for feeding the waveguide with microwaves carrying information and/or instructions for all moving elements, and wherein the top waveguide is connected to a member for feeding it with microwaves carrying information and/or instructions to and from those moving elements moving along the individual lengths delimited by pairs of successive electrical short circuits and the associated absorbent materials.

2. A system for transmitting broadband data and/or instructions between at least one moving element and a control station for said element, the system including a hollow tube running parallel to the path followed by the moving element, said hollow tube constituting a waveguide having an emissive face pierced by a network of openings for passing electromagnetic radiation at microwave frequencies, said at least one moving element being provided with at least one antenna for microwaves disposed facing that face of the tube which is pierced with the network of openings, and the hollow tube being connected to at least one microwave feed member and to a member for receiving microwaves coming from the tube, wherein the network of openings pierced through the emitting face of the hollow tube is such as to enable microwave transmission between said openings and said antenna, and wherein the openings in the emitting face have a long dimension which is greater than a dimension perpendicular thereto, wherein some of said openings are perpendicular to the axis of the hollow tube so as to emit an axial component $E_z$ of the electrical field, and other of said openings are oblique relative to said axis so as to emit also a perpendicular component $E_y$ of the electrical field, said axial component $E_z$ conveying the data and/or the instructions, and said perpendicular component $E_y$ emitting information about the absolute position of the moving element, and other information related to said position, and wherein said at least one moving element has a transmission and reception antenna adapted to receive said axial component $E_z$ and a localization antenna adapted to receive said perpendicular component $E_y$.

3. A system according to claim 2, wherein the member for feeding the hollow tube with microwaves is a transmitter for transmitting at two different frequencies, one of the frequencies being used for exchanging data and/or instructions, and the other providing major fluctuations in amplitude of the signals received by an antenna fixed to the moving element and remaining close to the face of the tube pierced with said openings, thereby enabling the location and the speed of the moving element to be measured by counting numbers of openings.

4. A system according to claim 2, wherein the tube is a hollow rail for supplying power to a railway vehicle.

5. A system according to claim 4, wherein the inside faces of the hollow tube are provided with an electrolytic deposit of a metal which is a good conductor of electricity.

6. A system according to claim 2, wherein at least on some lengths of the hollow tube, the openings for enabling the moving element to be located and for measuring the speed are separated by intervals such that the speed of the moving element can be measured by setting a time interval at which the corresponding antenna of the moving element should pass over said openings.

* * * * *